US005083713A

United States Patent [19]

Kanda et al.

[11] Patent Number: 5,083,713

[45] Date of Patent: Jan. 28, 1992

[54] PROCESS FOR DISINTEGRATING SILICA FINE POWDER

[75] Inventors: Hitoshi Kanda, Yokohama; Tsuko Kobayashi, Tokyo, both of Japan

[73] Assignee: Canon Kabushiki Kaisha, Tokyo, Japan

[21] Appl. No.: 506,827

[22] Filed: Apr. 10, 1990

[30] Foreign Application Priority Data

Apr. 10, 1989 [JP] Japan ..... 1-087975
Apr. 10, 1989 [JP] Japan ..... 1-087976

[51] Int. Cl.[5] ..... B02C 19/00
[52] U.S. Cl. ..... 241/30; 241/15
[58] Field of Search ..... 241/19, 5, 24, 39, 29, 241/23, 79.1, 76, 15, 77, 78, 80, 97, 30; 430/111, 137, 121

[56] References Cited

U.S. PATENT DOCUMENTS 4,479,613 10/1984 Rowledge ..... 241/189 R X
4,733,826 3/1988 Komori et al. ..... 241/188 R X
4,756,482 7/1988 Matje et al. ..... 241/16
4,839,255 6/1989 Hyosu et al. .
4,844,349 7/1989 Kanda et al. ..... 241/19

*Primary Examiner*—Timothy V. Eley
*Attorney, Agent, or Firm*—Fitzpatrick, Cella, Harper & Scinto

[57] ABSTRACT

A process for disintegrating an agglomerated mass of silica fine powder comprises introducing the silica fine powder into an impact portion defined by either a rotatory strip and a fixed strip or two rotatory strips, and having a gap therebetween of 0.5 to 10 mm and mechanically impacting the silica fine powder by at the impact portion to disintegrate the agglomerated mass.

11 Claims, 3 Drawing Sheets

PROCESS FOR DISINTEGRATING SILICA FINE POWDER

BACKGROUND OF THE INVENTION

Field of the Invention and Related Background Art

This invention relates to a process for disintegrating silica fine powder, particularly to a process for disintegrating silica fine powder with primary particle sizes of 1μ or less.

Fine powder, particularly fine powder with primary particle sizes of 1μ or less, is itself susceptible to agglomeration and extremely rarely exists as primary particles. When such fine powder is used for various additives, if it is in an agglomerated state, performances as fine powder cannot be exhibited to bring about lowering in efficiency. For this reason, it has been desired to have a method for disintegrating such agglomerate of fine powder.

In the prior art, as the disintegrating method of fine powder, there have been known the method in which fine powder is treated under the conditions to the extent which do not crush the particles by controlling the operational conditions of a pulverizer such as the jet mill or impact system pulverizer.

However, in such method, although disintegrating is possible when the agglomerated mass of fine powder is large, or when the true specific gravity of fine powder is large, it is difficult to perform disintegration sufficiently when the size of the agglomerated mass is several 10 μm or less as in the case of silica fine powder or when the apparent density is small as in the case of silica fine powder.

Particularly, it is very difficult to disintegrate fine powder with very strong agglomerating tendency with primary particle sizes of 0.1μ or less such as silica fine powder according to the conventional method.

There is also a method for disintegrating fine powder by use of a medium as in the ball mill, but in this case, a long time is required, whereby there is the tendency that grinding by rubbing mutually between media is generated to entrain impurities into fine powder undesirably. Further, in the case of the ball mill, it is disintegration in a nonuniform system and may sometimes form a new agglomerated product undesirably. Otherwise, a mixing device can be also used as the disintegrator, but in the ordinary mixing device, it is difficult to obtain sufficient disintegration due to weak shearing force.

SUMMARY OF THE INVENTION

An object of the present invention is to provide a method for disintegrating silica fine powder efficiently in view of the problems of the prior art as described above.

Further, it is an object of the present invention to provide a method for disintegrating efficiently silica fine powder with primary particle sizes of 1μ or less.

Further, it is another object of the present invention to provide a method for disintegrating efficiently hydrophobic silica fine powder.

According to the present invention, there is provided a process for disintegrating an agglomerated mass of silica fine powder comprising:

introducing the silica fine powder containing the agglomerated mass into an impact portion having the shortest gap of 0.5 to 10 mm formed by a rotatory strip and a fixed strip or an impact portion having the shortest gap of 0.5 to 10 mm formed by two kinds of rotatory strips, and disintegrating said agglomerated mass of silica fine powder by mechanical impact at said impact portion.

BRIEF DESCRIPTION OF THE DRAWINGS

FIG. 1-2 is an enlarged schematic sectional view showing a part of the device shown in FIG. 1-1;

FIG. 2-1 is a schematic sectional view showing another example of the desintegrating device for practicing the present process;

FIG. 2-2 and FIG. 2-3 are enlarged schematic views each showing a part of the device shown in FIG. 2-1; and FIG. 3 and FIG. 4 are schematic sectional views each showing another example of the disintegrating device for practicing the present process.

DESCRIPTION OF THE PREFERRED EMBODIMENT

As an example of the disintegrating device for practicing the present process, a disintegrator (see FIG. 1-1 and FIG. 2-1) which has recycle function and gives impact between a rotating blade or hammer (rotatory strip) and a liner (fixed strip) may be effectively used.

The peripheral speed of the tip end of the rotatory strip in said device may be preferably 20 to 300 m/sec, and the residence time at the impact portion may be preferably 0.02 to 12 sec.

Figure 1:
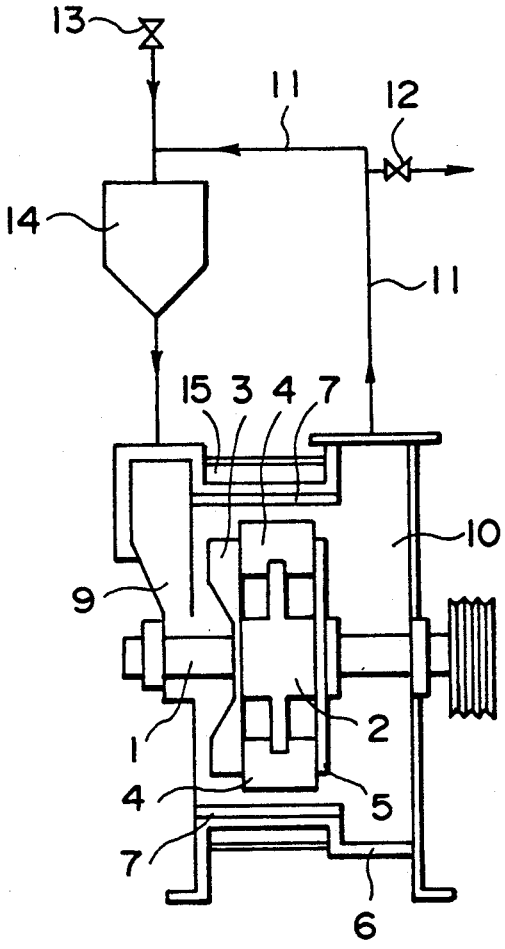
FIG. 1-1 is a schematic sectional view showing an example of the disintegrating device for practicing the present process.
Figures 1, 2:
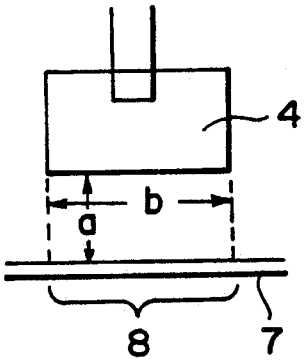

Since silica fine powder is collected near the liner by centrifugal force in a device of the type shown in FIG. 1-1 or FIG. 2-1, the latitude of the concentration of silica fine powder is wide. The shortest gap between the blade or hammer and the liner may be preferably 0.5 to 10 mm, more preferably 1 mm to 3 mm, to give good results.

The device for disintegrating the agglomerated mass of silica fine powder shown in FIG. 1-1 is equipped with a rotatory shaft 1, a rotor 2, a dispersing vane 3, a blade 4, a partitioning disc 5, a casing 6, a liner 7, an impact portion 8, an inlet chamber 9, an outlet chamber 10, a return passage 11, a product take-out valve 12, an introducing inlet 13, a hopper 14 and a jacket 15.

Silica fine powder is thrown through the introducing inlet 13 into the hopper 14, and the silica fine powder supplied from the hopper 14 passes through the inlet chamber 9, passes through the impact portion 8 between the liner 7 and the blade 4 equipped to the rotor 2 which rotates along the rotating dispersing vane 3, passes through the outlet chamber 10, passes through the return passage 11 and the hopper 14, and again circulates through the same circuit. After completion of the disintegration treatment, silica fine powder is taken out through the take-out outlet 12.

Here, the silica fine powder is subjected to disintegrating treatment by receiving impact at the impact portion 8 between the blade 4 and the liner 7. If necessary, cooling water may be preferably flowed through the jacket 15 to control the atmosphere temperature. In FIG. 1-2, the gap a between the blade 4 and the liner 7 is the shortest gap, and the space corresponding to the width b of the blade 4 is the impact portion.

The device for disintegrating agglomerated mass of silica fine powder shown in FIG. 2-1 is equipped with a rotatory shaft 16, a casing 17, a liner 18, a wind blowing vane 19, a rotor (equipped with blade) 20, an outlet 21, an introducing inlet 22, a return passage 23, a silica fine powder outlet 24, an inlet 25, a jacket 26, and a hopper 39.

Figures 1, 2:
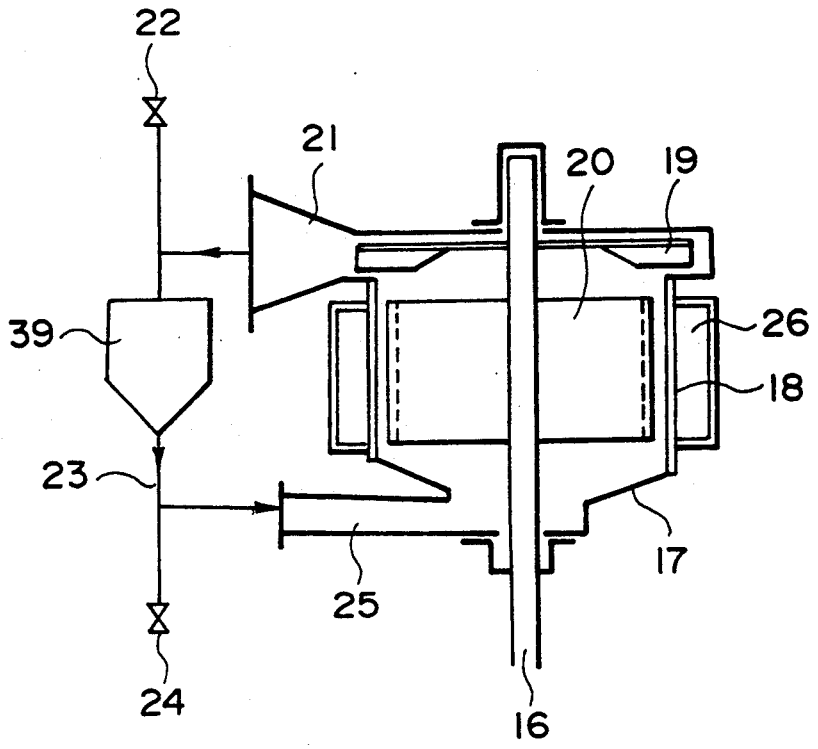
Figure 2:
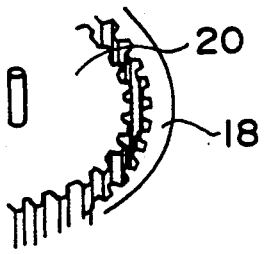
Figures 2, 3:
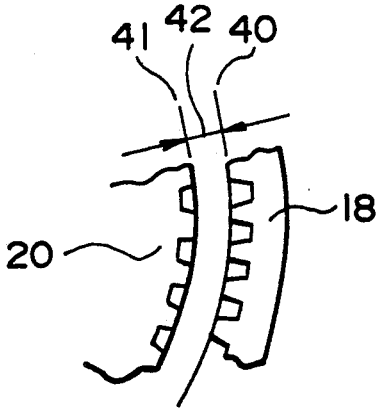
Figure 3:
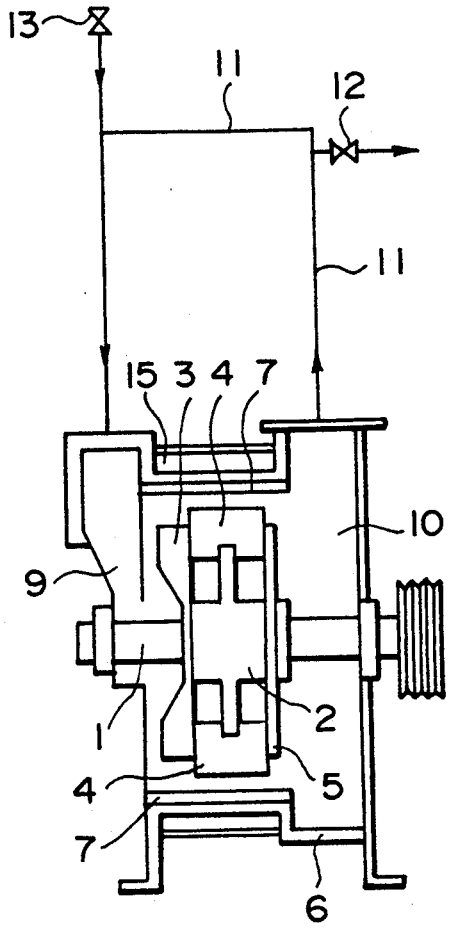

FIG. 2-3 shows the positional relationship between the liner 18 and the rotating rotor 20 of the disintegrating device, and the shortest gap between the liner 18 and the rotor 20 refers to the difference in radius between the two kinds of circles of the circumference 40 obtained by connecting the tip ends of the projected portions to the inner circumference of the liner 18 and the locus 41 of the projected portion of the rotor 20. The same is the case when employing a blade or a hammer in place of the rotor 20.

Provision of a hopper in the recycle passage is an effective means for increasing the amount of silica fine powder treated per one pass.

Particularly, fine powder such as silica fine powder has very small bulk density, and therefore its treated amount is limited in the absence of the hopper portion. In solving such problem, provision of a hopper portion is effective, whereby bulk treatment becomes possible to effect higher efficiency.

Figure 4:
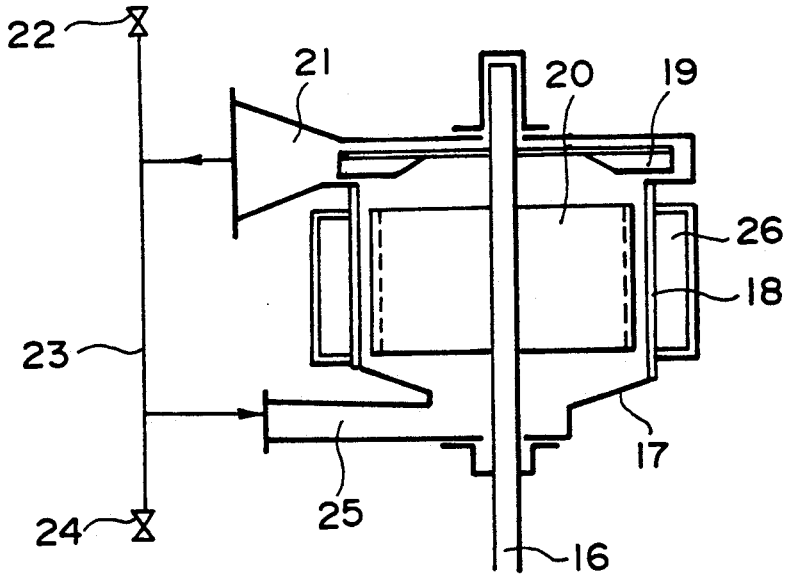

FIG. 3 and FIG. 4 respectively show the devices having no hopper.

If silica fine powder is easily disintegratable, the disintegration treatment may be also performed by one pass continuously without the recycling.

According to the process of the present invention, silica fine powder can pass surely through the narrow gap between the rotatory strip and the fixed strip, thereby receiving impact from the rotatory strip, and the recycle function is imparted to the disintegrator whereby reliable disintegration is rendered possible.

The present invention is effective for disintegration of silica fine powder with primary particle sizes of $1\mu$ or less, particularly $0.1\mu$ or less.

Silica fine powder has generally most of its primary particles associated in plural numbers to be agglomerated and form secondary particles.

For loosening agglomerated mass of silica fine powder, sure shearing force is required, and in the present invention, the agglomerated mass of silica fine powder can be disintegrated by allowing it to pass surely through a narrow gap and subjecting it to the mechanical impact in the impact partion, whereby the disintegration treatment can be done more efficiently than in the prior art device. Further, when the silica fine powder is recycled, by imparting mechanical impact at the impact portion repeatedly to the agglomerated mass, disintegration can be effected more efficiently. Particularly, the process of the present invention is effective for hydrophobic silica fine silica subjected to hydrophobicity treatment with a hydrophobic agent such as silicone oil, because it has stronger agglomerating tendency.

The disintegration degree of the silica fine powder disintegrated according to the process of the present invention can be ascertained by the change in bulk density.

To take an example of silica fine powder, silica fine powder available in the prior art has a bulk density of 40 mg/cm$^3$ or more, generally 50 mg/cm$^3$ or more, but when disintegration is performed according to the process of the present invention, the bulk density can be made smaller than 50 mg/cm$^3$, preferably less than 40 mg/cm$^3$. Further, the degree of disintegration of silica fine powder can be also confirmed by observation with an electron microscope.

In the present invention, bulk density is a value determined as described below.

A cell of 100 cm$^3$ volume is placed stationarily on a horizontal plane, a material is dropped gently from about 3 cm above the opening of the cell to fill internally of the cell, and the excessive portion raised higher than the horizontal plane of the opening is removed, followed by measurement of the weight, and bulk density is calculated from its value. According to the process of the present invention, the bulk density of silica fine powder can be lowered to 65% or lower, further 50% or lower.

In the present invention, lowering in bulk density of silica fine powder is calculated from the following formula:

$$\left[\begin{array}{c}\text{Lowering in}\\ \text{bulk density (\%)}\end{array}\right] = \frac{\left[\begin{array}{c}\text{Bulk density of silica fine}\\ \text{powder after disintegration}\\ \text{treatment (mg/cm}^3\text{)}\end{array}\right]}{\left[\begin{array}{c}\text{Bulk density of silica fine}\\ \text{powder before disintegration}\\ \text{treatment (mg/cm}^3\text{)}\end{array}\right]} \times 100$$

When the fine powder disintegrated by the process of the present invention is used as the additive, the adding amount can be smaller as compared with undisintegrated silica fine powder, and also the dispersibility is good to be very efficient.

Particularly, the silica fine powder disintegrated by the process of the present invention is useful as the additive for toner or developer.

In the process of the present invention, since silica fine particles are disintegrated to near primary particles, when such disintegrated silica fine particles are mixed with toner particles, they are attached onto the toner particle surfaces under the state dispersed uniformly and well, whereby there is the advantage that those once attached onto the toner particle surfaces will be liberated with difficulty and the toner obtained will not be deteriorated with lapse of time even when left to stand for a long term.

Since the agglomerated mass of silica fine powder is loosened, fog which seems to be caused by the agglomerated mass of silica fine powder is reduced. By use of the silica fine powder integrated according to the process of the present invention, the amount of silica mixed with the toner particles can be smaller as compared with the prior art, whereby cost-down can be effected.

EXAMPLE 1

Hydrophobic colloidal silica fine powder A which was obtained by subjecting the colloidal silica fine powder, synthesized by the dry process, to the hydrophobicity treatment with dimethylsilicone oil was disintegrated by means of the device shown in FIG. 1-1 at the shortest gap a of 1 mm, a blade width b of 30 mm and a peripheral speed of blade of 70 m/sec for 3 minutes. The capacity of the hopper 14 was 10 liters, the diameter of the rotor 2 (length from the tip end of the blade to the opposed tip end of the blade) was 300 mm, and disintegration was effected while circulating the silica fine powder. The bulk density of the silica fine powder before the disintegration was 43 mg/cm$^3$, and agglomerated masses of several 10μ were seen to dot when observed by an electron microscope.

When the bulk density of the silica fine powder after the disintegration treatment was measured, it was 20 mg/cm$^3$ (lowering degree of bulk density: about 47%), and the agglomerated mass was confirmed to be well loosened with substantially no agglomerated mass being present when observed by an electron microscope.

The silica fine powder was disintegrated at a rate of 100 g/min.

EXAMPLE 2

Hydrophobic colloidal silica fine powder B (Tullanox T-500, Tulco Co.) which was obtained by treating the colloidal silica fine powder, synthesized by the dry process, with a silane coupling agent was disintegrated by means of the device shown in FIG. 1-1 at the shortest gap of 1 mm and a peripheral speed of blade of 70 m/sec for 3 minutes. The bulk density of the silica fine powder before disintegration was 60 mg/cm$^3$, and agglomerated masses of several 10μ were seen to dot when observed by an electron microscope.

When the bulk density of the silica fine powder after the disintegration treatment was measured, it was 25 mg/cm$^3$ (lowering degree of bulk density: about 42%), and the agglomerated mass was confirmed to be well loosened with substantially no agglomerated mass being present when observed by an electron microscope.

The silica fine powder was disintegrated at a rate of 125 g/min.

EXAMPLE 3

The same silica fine powder B as in Example 2 was disintegrated by means of the device shown in FIG. 4 at the shortest gap of 2 mm and a peripheral speed of rotor of 70 m/sec for 5 minutes.

When the bulk density of the silica fine powder after disintegration treatment was measured, it was 30 mg/cm$^3$ (lowering degree of bulk density: about 50%), and the agglomerated mass was confirmed to be well loosened with substantially no agglomerated mass being present when observed by an electron microscope.

The silica fine powder was disintegrated at a rate of 150 g/min.

EXAMPLE 4

Hydrophilic colloidal silica fine powder C (Nipsil E, supplied by Nippon Silica Co., Ltd.) synthesized by the wet process was disintegrated by means of the device shown in FIG. 1-1 at the shortest gap of 1 mm and a peripheral speed of blade of 70 m/sec for 3 minutes.

The bulk density of the silica fine powder before the disintegration was 70 mg/cm$^3$, and agglomerated masses of several 10μ were seen to dot when observed by an electron microscope.

When the bulk density of the silica fine powder after disintegration treatment was measured, it was 45 mg/cm$^3$ (lowering degree of bulk density: about 64%), and the agglomerated mass confirmed to be well loosened.

The silica fine powder was disintegrated at a rate of 225 g/min.

EXAMPLE 6

Hydrophobic colloidal silica fine powder A which was obtained by subjecting colloidal silica fine powder synthesized by the dry process, to the hydrophobicity treatment with dimethylsilicone oil was disintegrated by means of the device shown in FIG. 3 at the shortest gap of 1 mm and a peripheral speed of blade of 70 m/sec for 3 minutes. The bulk density of the silica fine powder before disintegration was 43 mg/cm$^3$, and agglomerated masses of several 10μ were seen to dot when observed by an electron microscope.

When the bulk density of the silica fine powder after the disintegration treatment was measured, it was 20 mg/cm$^3$, and the agglomerated mass was confirmed to be well loosened with substantially no agglomerated mass being present when observed by an electron microscope.

The silica fine powder was disintegrated at a rate of 10 g/min.

EXAMPLE 7

Hydrophobic colloidal silica fine powder B (Tullanox T-500, Tuclo Co.) which was obtained by treating the colloidal silica fine powder, synthesized by the dry process, with a silane coupling agent was disintegrated by means of the device shown in FIG. 3 at the shortest gap of 1 mm and a peripheral speed of blade of 70 m/sec for 3 minutes. The bulk density of the silica fine powder before disintegration was 60 mg/cm$^3$, and agglomerated masses of several 10μ were seen to dot when observed by an electron microscope.

When the bulk density of the silica fine powder after the disintegration treatment was measured, it was 25 mg/cm$^3$, and the agglomerated mass was confirmed to be well loosened with substantially no agglomerated mass being present when observed by an electron microscope.

The silica fine powder was disintegrated at a rate of 12 g/min.

EXAMPLE 8

The same silica fine powder B as in Example 7 was disintegrated by means of the device shown in FIG. 4 at the shortest gap of 2 mm and a peripheral speed of rotor of 70 m/sec for 5 minutes.

When the bulk density of the silica fine powder after the disintegration treatment was measured, it was 30 mg/cm$^3$, and the agglomerated mass was confirmed to be well loosened when observed by an electron microscope.

The silica fine powder was disintegrated at a rate of 15 g/min.

EXAMPLE 9

Colloidal silica fine powder C (Nipsil E, Nippon Silica Co., Ltd.) synthesized by the wet process was disintegrated by means of the device shown in FIG. 1-1 at the shortest gap of 1 mm and a peripheral speed of blade of 70 m/sec for 3 minutes. The bulk density of the silica fine powder before the disintegration was 70 mg/cm$^3$, and agglomerated masses of several 10μ were seen to dot when observed by an electron microscope.

When the bulk density of the silica fine powder after the disintegration treatment was measured, it was 45 mg/cm$^3$, and the agglomerated mass was confirmed to be well loosened when observed by an electron microscope.

The silica fine powder was disintegrated at a rate of 23 g/min.

COMPARATIVE EXAMPLES

The silica fine powders used in Examples 1–4 were disintegrated in the same manner as in Example 1 except for using a jet mill in place of the disintegrator used in Example 1. The bulk densities of the respective silica fine powders before and after the disintegration are shown in the following Table.

| | Bulk density before integration | Bulk density after integration | Lowering ratio of bulk density |
|---|---|---|---|
| Silica fine powder A | 43 mg/cm$^3$ | 30 mg/cm$^3$ | 70% |
| Silica fine powder B | 60 mg/cm$^3$ | 42 mg/cm3 | 70% |
| Silica fine powder C | 70 mg/cm$^3$ | 56 mg/cm$^3$ | 80% |

In disintegration by the jet mill, the extent of disintegration of the agglomerated mass of silica fine powder is found to be inferior as compared with the process of the present invention.

We claim:

1. A process for disintegrating an agglomerated mass of silica fine powder in a disintegrator having an impact portion defined by either a rotatory strip and a fixed strip or a two rotatory strips, comprising the steps of:

introducing the silica fine powder containing the agglomerated mass into the impact portion having a gap between the strips of 0.5 to 10 mm, and mechanically impacting the agglomerated mass of silica fine powder at the impact portion to disintegrate the agglomerated mass.

2. The process according to claim 1, wherein the smallest gap at the impact portion is 1 to 3 mm.

3. The process according to claim 1, wherein the rotatory strip is rotated so that a tip end of the rotatory strip has a peripheral speed of 20 to 300 m/sec.

4. The process according to claim 1, wherein the silica fine powder before disintegration has a bulk density of 40 mg/cm$^3$ or higher, and the silica fine powder after disintegration has a bulk density less than 40 mg/cm$^3$.

5. The process according to claim 1, wherein the silica fine powder before disintegration has a bulk density of 50 mg/cm$^3$ or higher, and the silica fine powder after disintegration has a bulk density less than 50 mg/cm$^3$.

6. The process according to claim 1, wherein the silica fine powder comprises hydrophobic silica fine powder.

7. The process according to claim 1, wherein the silica fine powder comprises hydrophobic silica fine powder treated with silicone oil.

8. The process according to claim 1, wherein the silica fine powder comprises hydrophobic silica fine powder treated with a silane coupling agent.

9. The process according to claim 1, wherein the silica fine powder is disintegrated so that the bulk density may be lowered to 65% or lower based on the bulk density before disintegration.

10. The process according to claim 1, wherein the silica fine powder is stored in a hopper before introduction into the impact portion.

11. The process according to claim 1, wherein the silica fine powder has a primary particle size of 1 μm or less.

* * * * *

UNITED STATES PATENT AND TRADEMARK OFFICE

CERTIFICATE OF CORRECTION

PATENT NO. : 5,083,713

DATED : January 28, 1992

INVENTOR(S) : Hitoshi Kanda, et al.

It is certified that error appears in the above-identified patent and that said Letters Patent is hereby corrected as shown below:

Title page:

[75] INVENTORS:

"Tsuko Kobayashi," should read --Atsuko Kobayashi,--.

COLUMN 3:

Line 48, "partion," should read --portion,--.

COLUMN 5:

Line 59, "confirmed" should read --was confirmed--.

COLUMN 7:

Line 28, "a" should be deleted.

Signed and Sealed this

Twenty-ninth Day of September, 1992

*Attest:*

DOUGLAS B. COMER

*Attesting Officer*

*Acting Commissioner of Patents and Trademarks*